United States Patent [19]

Price et al.

[11] 4,046,976

[45] Sept. 6, 1977

[54] PRESSURE ACTUATED SENSOR SWITCH WITH BOBBIN, TRIP CORD AND BREAKWIRE

[75] Inventors: Jerome J. Price, Bloomington; Carl G. Karsten, Crystal; William D. Paggen, Minneapolis, all of Minn.

[73] Assignee: The United States of America as represented by the Secretary of the Army, Washington, D.C.

[21] Appl. No.: 649,626

[22] Filed: Jan. 16, 1976

[51] Int. Cl.[2] ..... H01H 3/02

[52] U.S. Cl. ..... 200/61.93; 200/83 R; 200/61.08

[58] Field of Search ..... 200/61.08, 61.93, 52 R, 200/83 R, 83 S, 83 T, 161; 102/7.4, 37.6, 89, 70 S, 71; 242/41

[56] References Cited

U.S. PATENT DOCUMENTS

| | | | |
|---|---|---|---|
| 1,309,708 | 7/1919 | Velo | 102/7.4 |
| 3,003,045 | 10/1961 | Tichenor | 200/61.08 |
| 3,156,792 | 11/1964 | Long | 200/83 T X |
| 3,515,067 | 6/1970 | Min | 102/37.6 X |

*Primary Examiner*—James R. Scott

*Attorney, Agent, or Firm*—Nathan Edelberg; A. Victor Erkkila; Max Yarmovsky

[57] ABSTRACT

A spring loaded trip string holding bobbin is deployed when a gas pressure supply is activated. The gas pressure forces a diaphragm member to move a detented biased camming release ring from a locking position to a deploying position. The initial movement of the release ring permits detent balls to move and release a sleeve element which holds the bobbin locked to a sensor assembly and initially prevents the movement of a post holding a breakwire sensing element which is attached to the personnel extended trip string. The release ring after a short interval of time automatically returns to its initial position unlocking the bobbin post so that the breakwire and the device will be responsive to string disturbance.

3 Claims, 7 Drawing Figures

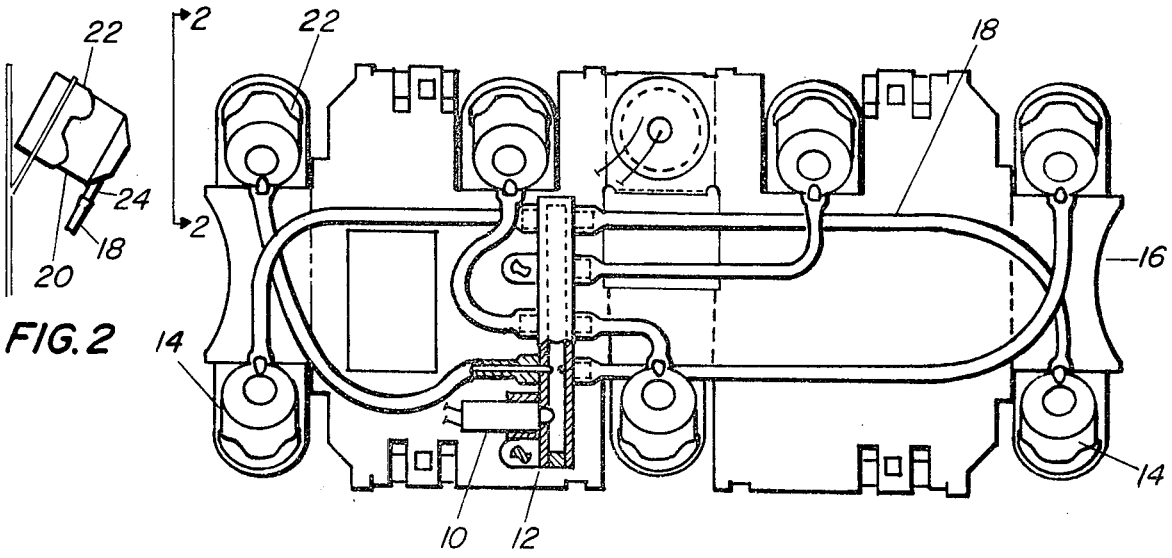
FIG. 2
FIG. 1
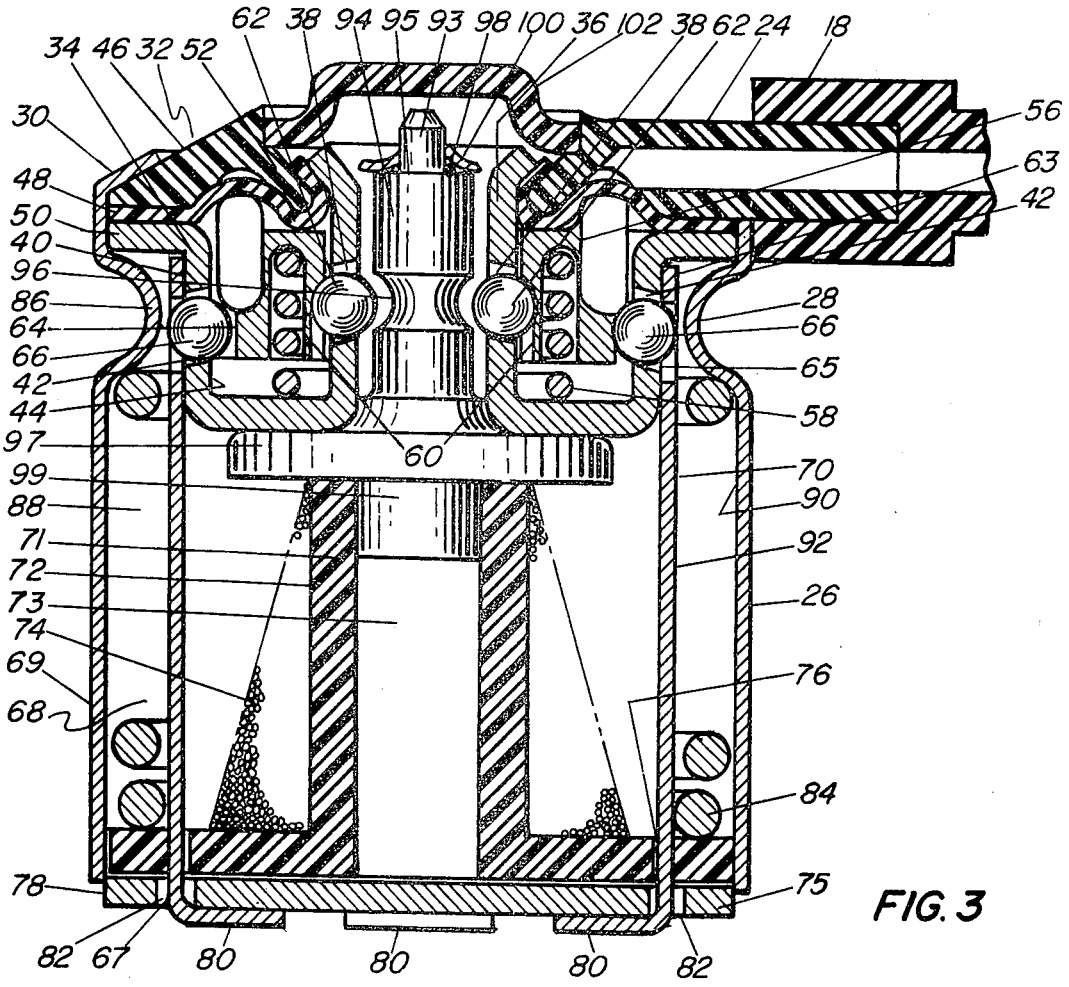
FIG. 3

PRESSURE ACTUATED SENSOR SWITCH WITH BOBBIN, TRIP CORD AND BREAKWIRE

GOVERNMENTAL INTEREST

The invention described herein was made in the course of a contract with the Government and may be manufactured, used and licensed by or for the Government for governmental purposes without the payment to use of any royalty thereon.

BACKGROUND OF THE INVENTION

Various means have been used in the prior art to release a personnel sensing device. One previous release method employed a pyrocord communication element and a thermite pellet to generate and melt a fusible joint. This prior art means was unsatisfactory because it produced a smoke and fire signature which made its position visible and in addition frequently damaged the trip line and switch elements of the sensor.

The present invention overcomes some of the aforementioned problems by having rugged reliable parts. The present device is capable of simultaneous release with other sensors, eliminates the smoke/fire signature, and does not degrade the trip line or switch elements.

SUMMARY OF THE INVENTION

The present invention relates to a pressure actuated release means for a trip line personnel sensor. The present invention permits a near simultaneous release of a plurality of sensors in a system and enables a substantial increase in sensitivity of the sensor network.

An object of the present invention is to provide a pressure actuated personnel sensor which is inexpensive and rugged.

Another object of the present invention is to provide a pressure actuated personnel sensor dispensing means which does not have a smoke signature.

Another object of the present invention is to provide a pressure actuated personnel sensor means which will not damage or degrade a trip wire line and switch elements.

Another object of the present invention is to provide a pressure actuated personnel sensor means which is suitable for near simultaneous release of a plurality of sensors in a release system.

A further object of the present invention is to provide a pressure actuated personnel sensor means which provides a near simultaneous release of a plurality of sensors in a system which has a substantial increase in sensitivity of the overall sensor network.

For a better understanding of the present invention, together with other and further objects thereof, reference is made to the following descriptions taken in connection with the accompanying drawings.

BRIEF DESCRIPTION OF THE DRAWINGS

FIG. 1 is a plan view of a plurality of pressure actuated sensors in a subsystem in a flat dispensing preform.

FIG. 2 is a side view of a pressure actuated sensor taken along line 2—2 of FIG. 1.

FIG. 3 is a diametral longitudinal partial cross-sectional view of the pressure actuated sensor in its unfired, non-released, condition.

Throughout the following description like reference numerals are used to denote like parts of the drawings.

DESCRIPTION OF THE PREFERRED EMBODIMENTS

Figure 4:
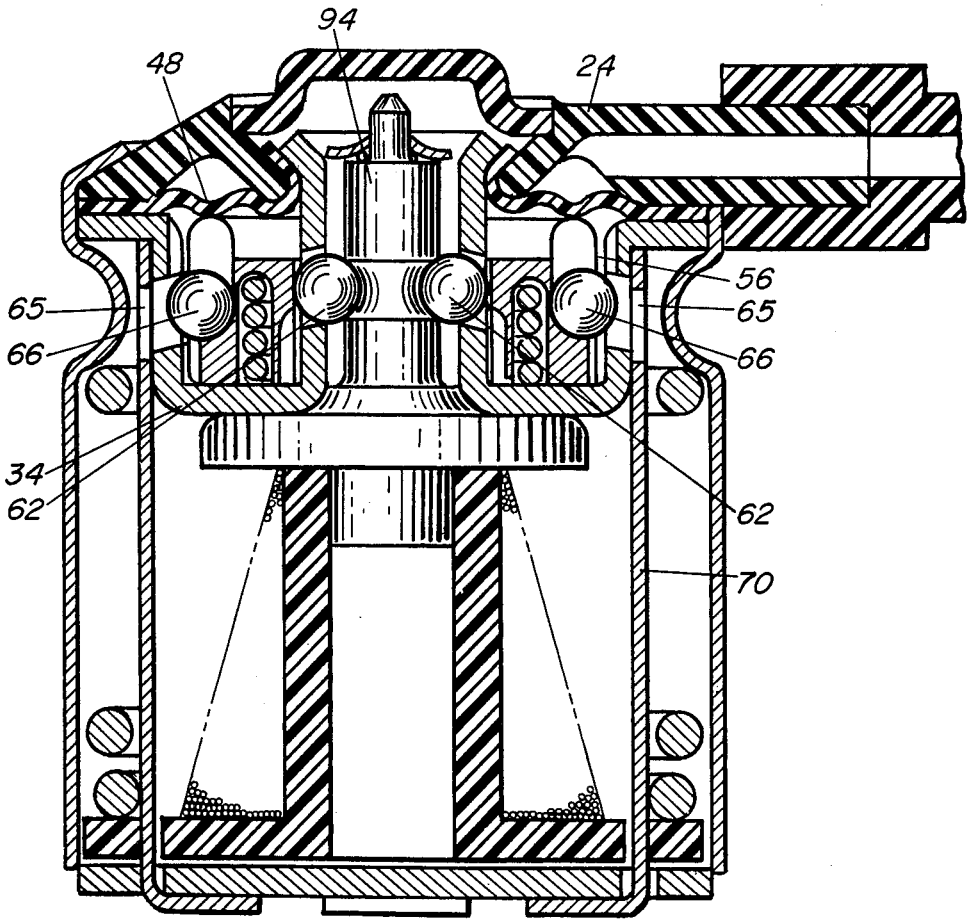
FIG. 4 is a diametral longitudinal partial cross-sectional view of the pressure actuated sensor just after a gas supply has been actuated.

Referring now to FIGS. 1 and 2 a gas generator 10, manifold 12, and pressure actuated sensors 14 are mounted on a metal preform 16. Pressure actuated sensors 14 are pneumatically connected to the manifold 12 by means of transmission tubes 18. The case 20 of sensor 14 is fixedly held to the preform 16 by means of integral clips 22. When the gas generator 10 is electrically fired the manifold is pressurized causing gas pressure to be raised in the connected transmission tubes 18 and in turn in each of the sensors 14 through plate member inlet port 24.

Referring now to FIG. 3 a tubularly shaped housing 26 has a peripherally disposed annular inwardly protruding groove 28 in its forward end 30. Contained within the housing forward end 30 and housing groove 28 is a pressure sensitive release-lock mechanism assembly 32 which comprises a cup shaped member 34, made of steel, having an integral tubular section 36 which has a plurality of peripherally inner detent holes 38 and a flanged exterior wall 40 having a plurality of peripherally disposed outer detent holes 42 and an annular sliding groove 44 disposed interior wall surface of flanged exterior wall 40 and the exterior side of tube 36. A cover plate 46 and a circular diaphragm 48 disposed on are made of plastic material and their intermediate housing forward end 30 and a flange 50. Diaphragm 48 is held on its inner edges intermediate cover plate projection member 52 and the open end 54 of the cup tube 36. A spring loaded release-lock ring camming sheet 56 is slidably and biasedly positioned by ring spring 58 in the cup annular groove 44. The release-lock ring 56 has an inner annular camming surface 60 which rests against a plurality of inner detent balls 62 and an outer annular camming surface 64 which rests against a plurality of outer detent balls 66.

When the pressure actuated sensor is in an unreleased unactivated position, as shown in FIG. 3, a spring loaded bobbin assembly 68 is fixedly held with the sleeve open rear end 69 and attached to the release-lock mechanism assembly 32 by outer detent balls 66. The bobbin assembly 68 comprises a sleeve 70, having a forward end 63 which has detent holes 65 therethrough which are in alignment with outer detent holes 42 and a rear end 67 having a plurality of integral lugs 80 protruding therefrom, a bobbin 72 made of such material as plastic having a central tubular section 71 which has an axial bore 73 therein and a flange section 75 which has a plurality of bobbin flange slots 76 therein which permit lugs 80 of sleeve 70 to pass therethrough, a trip line or string 74 wound upon tubular section 71 and having a first end fixed thereto, a cover member 78 which is fixedly held to sleeve 70 by sleeve lugs 80 which pass through cover slots 82 and then bent, and a deployment helical spring 84 which is under compression and operatively disposed intermediate the bobbin flange 75 and the housing inwardly protruding annular section 86 and between the annular space 88 located between the interior side 90 of housing 26 and the exterior side 92 of sleeve 70. A switch post 94 has an axial projection 93 on a first end 95 and a flange 97 which is located between an annular detent groove 96 and the other end 99 of post 94. The other end of trip line 74 is anchored to switch post 94. The initial detenting of switch post 94 during deployment of the bobbin assembly 68 prevents the rupture of breakwire 98 at the first interval of time. The breakwire 98 is fixedly held on first end 95 of switch post 94 by a retaining washer 100. The other end 99 slidably fits into the bobbin axial bore 73 with the post flange resting on top of tubular section 71. A post switch cover 102 made of such material as plastic, protects the sensor from damage during the manufacturing procedure and insulates breakwire 98 which passes therethrough.

Referring now to FIGS. 1 and 4, in operation, when gas generator 10 is electrically fired, the manifold 12, transmission tubes 18 and the sensor 14 are pressurized. The pressure within the plate inlet port 24 causes the diaphragm 48, which may be made of a material such as a flexible plastic or rubber, to move, overcoming the force of the release ring spring 58 and moving the release-lock ring member 56 forward. The release-lock ring member 56 cams the inner detent balls 62 inwardly thereby locking up the switch post 94 to the release mechanism assembly 32 and cams the outer detent balls 66 inwardly taking balls 66 out of sleeve detent holes 65 thus disengaging the sleeve 70 from the cup shaped member 34.

Figure 5:
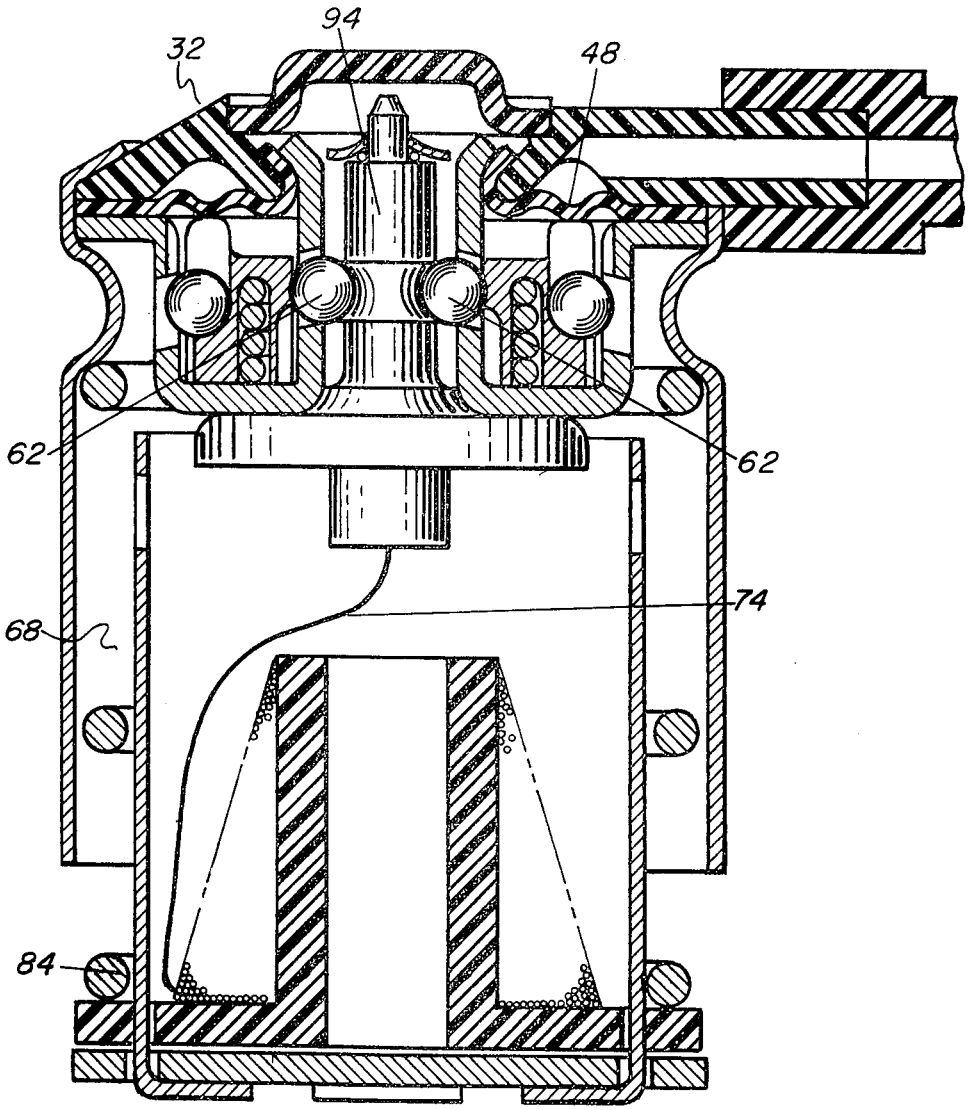
FIG. 5 is a diametral longitudinal partial cross-sectional view of the pressure actuated sensor just after a release ring and ball detenting means has released a string holding bobbin and locked a breakwire holding post in a "safe" position.
Figure 6:
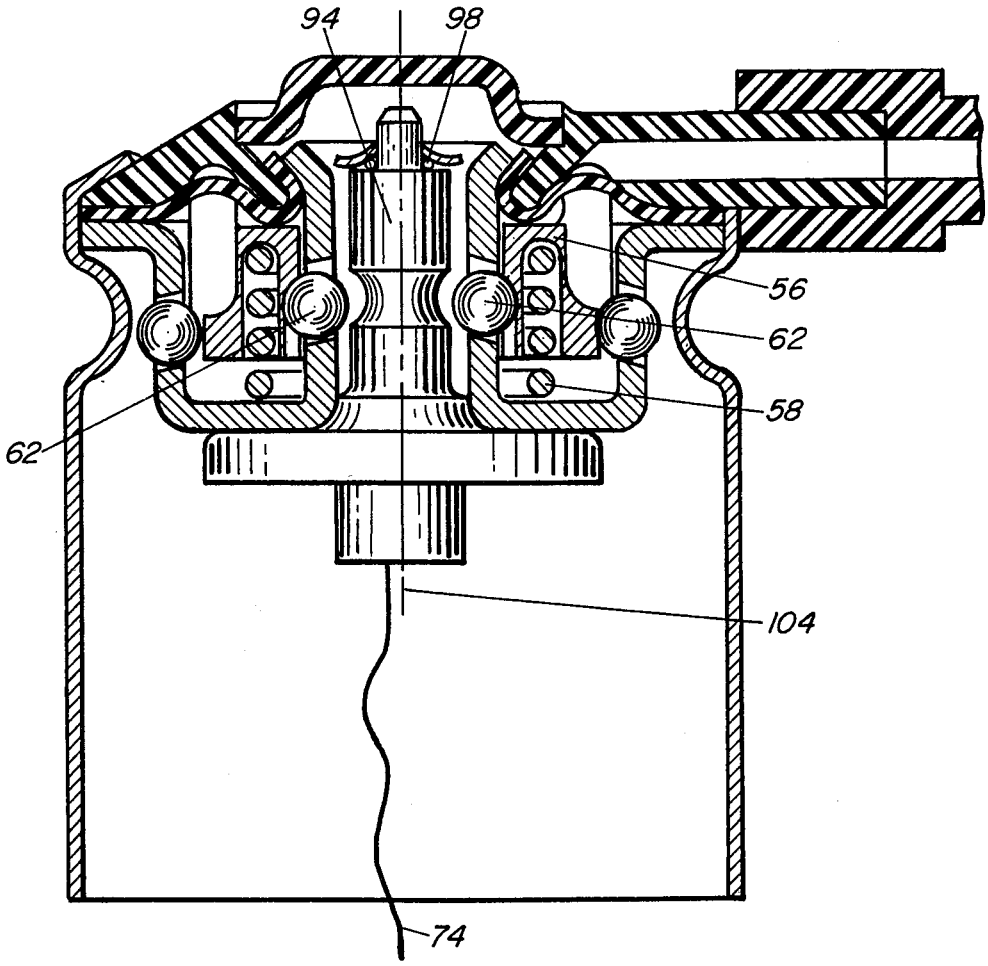
FIG. 6 is a diametral longitudinal partial cross-sectional view of a pressure actuated sensor that has dispensed a trip wire bobbin and a release ring and detent ball that have released a holding post so that the device is placed in an active sensing position.
Figure 7:
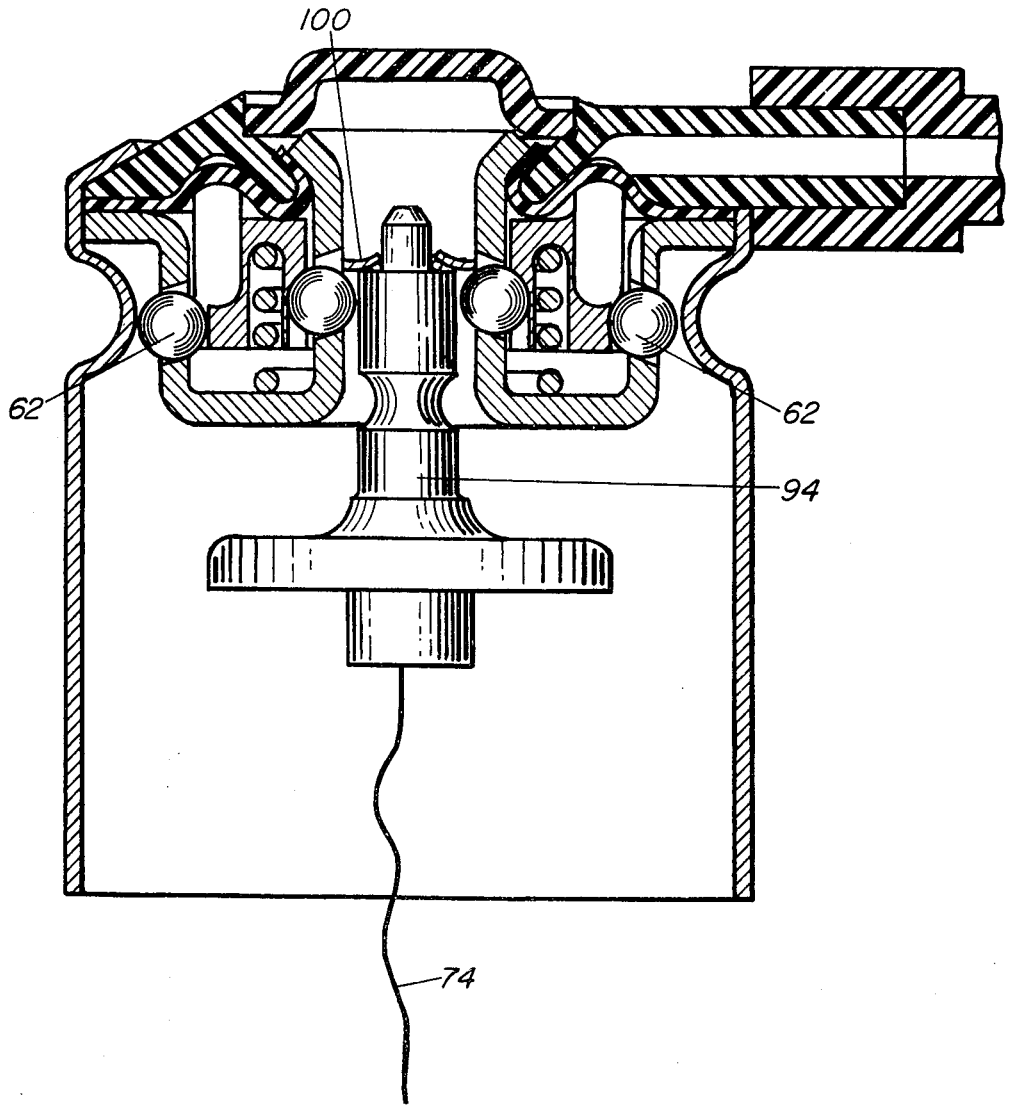
FIG. 7 is a diametral longitudinal partial cross-sectional view of the pressure actuated sensor in a disturbance operative sensing mode.

Referring now to FIG. 5, the bobbin assembly 68 separates from the release mechanism assembly 32 leaving the switch post 94 in place being held by inner detent balls 62. The sensor deployment, that is the extension of line 74, occurs under the launching force of the helical ejection spring 84. After a relatively short period of time, such as approximately 1 minute, the pressure of the gas against diaphragm 48 decays due to leakage and cooling. When the gas pressure drops sufficiently the release ring spring 58, as shown in FIG. 6, forces the release-lock ring member 56 back into their original position, allowing the inner and outer detent balls 62 to move outwardly thereby releasing switch post 94 so that it can move along its longitudinal axis 104. The system is now ready to sense any pull upon line 74 which is in excess of the breakwire 98 strength. The breakwire consists of a fine wire, made of such material as copper, which is part of an initiating electronic circuit. The breaking of this wire is the sensing signal for actuation of the circuit. In the event that there is a malfunction in the electronic circuit which causes the circuit to fail to respond to the breaking of the breakwire 98, the line 74 will pull the switch post 94 downwardly so that retaining washer 100 abuts against the inner detent balls 62 as shown in FIG. 7. Any additional force on line 74 will cause movement of the entire sensor and this movement may be used to activate an alternate disturbance sensing device.

The foregoing disclosure and drawings are merely illustrative of the principles of this invention and are not to be interpreted in a limiting sense. We wish it to be understood that we do not desire to be limited to the exact details of construction shown and described for obvious modification will occur to a person skilled in the art.

Having thus fully described the invention, what is claimed as new and desired to be secured by Letters Patent of the United States is:

1. A gas pressure actuated sensor which comprises:

a tubularly shaped housing having a forward end and a rear end, said forward end having a peripherally disposed inwardly protruding annular groove therein;

bobbin means biasedly disposed in said housing for deploying a personnel actuated trip line;

breakwire-disturbance sensitive means for detecting movement of said trip line by personnel after deployment of said bobbin means;

a release-lock gas pressure sensitive means operatively positioned in said housing intermediate the forward end of said housing and said inwardly protruding annular groove, for releasing said bobbin means upon an increase of gas pressure, for locking said breakwire means during a first interval of time and releasing said breakwire means after said first interval of time so that said breakwire is responsive to movement of said trip line, which includes;

a cup shaped member having an integral tubular section which has a plurality of peripherally disposed inner detent holes, a flange exterior wall having a plurality of peripherally disposed outer detent holes, and an annular sliding groove disposed intermediate the interior wall surface of said flanged exterior wall and the exterior wall surface of said tubular section;

a cover plate disposed in said housing having a gas inlet port integral therewith;

a ring camming member slidably and biasedly positioned in said cup member annular sliding groove, said ring member having an inner annular camming surface, an outer annular camming surface thereon and a spring groove on one end;

a circularly shaped diaphragm disposed intermediate said cover plate and said cup shaped member, said diaphragm operatively moving said ring camming member in response to gas being introduced into said inlet port;

a helical release ring spring biasedly positioned intermediate said ring camming member and said cup shaped member;

a plurality of inner detent balls disposed in said inner detent holes of said cup shaped member tubular section adjacent said inner annular camming surface of said ring camming member;

a plurality of outer detent balls disposed in the outer detent holes of said cup shaped member tubular section intermediate said outer camming surface of said ring member and said housing.

2. A pressure actuated sensor as recited in claim 1 wherein said bobbin means comprises:

a bobbin having a central tubular section and a flange section, said tubular section having an axial bore therein and said flange section having a plurality of slots therethrough;

a tubular sleeve having a forward end and a rear end, the forward end of said sleeve having a plurality of peripherally disposed sleeve detent holes therethrough and the rear end having a plurality to lugs protruding therefrom which pass through the slots of the flange of said bobbin;

a disc shaped cover member, having a plurality of cover slots in alignment with the slots of the flange of said bobbin, which abuts against said bobbin flange, wherein said sleeve lugs pass through said flange and cover slots, said lugs being bent against said cover member after passing therethrough;

a trip line personnel sensing element being wound around said bobbin tubular section said line having one end fixed thereto and the other end fixedly attached to said breakwire-disturbance sensitive means; and a biased helical deployment spring positioned intermediate said bobbin flange and said housing annular groove, wherein said deployment spring forcibly separates said bobbin means from said housing when said release-lock means releases said bobbin means.

3. A pressure activated sensor as recited in claim 1 wherein said breakwire-disturbance sensitive means comprises:

a switch post having a first end and a second end, said first end having an axial projection thereon, said second end having a flange operatively disposed thereto, and an annular detent groove intermediate said axial projection and said flange;

a breakwire positioned around said axial projection; and a retaining washer positioned on top of said breakwire for retaining said breakwire to said post, said breakwire being sensitive to movement of said post by said trip wire after bobbin deployment;

wherein said release-lock pressure sensitive means when pressurized through introduction of gas into said inlet post, said diaphragm moves against said ring camming member overcoming the force of said release ring spring and moves said ring camming member forwardly to cam said inner detent balls inwardly temporarily locking said switch post of said ring camming member, said ring member in addition cams said outer detent balls inwardly taking said outer detent balls out of said sleeve detent holes thereby disengaging said sleeve from said cup member thereby permitting said deployment spring to forcibly eject said bobbin means, and after a first interval of time a decay in gas pressure due to gas leakage and cooling permits said release ring spring to force said ring camming member back allowing said inner and outer detent balls to move outwardly and away from said switch post thereby releasing said switch post so that said breakwire may sense a pulling force by personnel on said deployed trip line.

* * * * *